United States Patent [19]

Best et al.

[11] Patent Number: 4,496,178

[45] **Date of Patent: * Jan. 29, 1985**

[54] EXTENDED LATCH TUBE ASSEMBLY

[75] Inventors: Walter E. Best; William R. Foshee, both of Indianapolis, Ind.

[73] Assignee: Best Lock Corporation, Indianapolis, Ind.

[ * ] Notice: The portion of the term of this patent subsequent to Mar. 9, 1997 has been disclaimed.

[21] Appl. No.: 414,826

[22] Filed: Sep. 3, 1982

[51] Int. Cl.[3] ..... E05C 1/12; E05B 9/00

[52] U.S. Cl. ..... 292/169.13; 292/337

[58] Field of Search ..... 292/337, 1, 169.13, 292/169.14, 169.18, 169, DIG. 44; 70/449, 461

[56] References Cited

U.S. PATENT DOCUMENTS

| | | | |
|---|---|---|---|
| 309,564 | 2/1884 | Best et al. | 213/205 |
| 2,250,036 | 7/1941 | Schlage | 292/337 |
| 2,299,181 | 10/1942 | Schlage | 292/337 |
| 2,444,819 | 7/1948 | Freysinger | 292/337 X |
| 2,719,744 | 10/1955 | Schlage | 292/337 X |
| 2,736,597 | 2/1956 | Russell | 292/169.13 |
| 2,765,187 | 10/1956 | Crandell | 292/1 |
| 2,768,014 | 10/1956 | Golden et al. | 292/169.13 |
| 2,822,202 | 2/1958 | Welch | 292/337 X |
| 3,018,651 | 1/1962 | Morrison | 292/169.13 X |
| 3,300,240 | 1/1967 | Tornoe et al. | 292/337 |
| 4,318,558 | 3/1982 | Best et al. | 292/173 |

OTHER PUBLICATIONS

Best Lock Corporation Catalog, pp. 3.10 and 6.10.

Best Lock Drawing A-53755 and Component Drawings A-53753, A-53754, and A-53814.

*Primary Examiner*—Gary L. Smith

*Assistant Examiner*—Russell W. Illich

*Attorney, Agent, or Firm*—Barnes & Thornburg

[57] ABSTRACT

An extended latch tube housing comprises a standard deep-drawn tubular shell having a front mounting flange and rear end wall, and a coaxial second deep-drawn shell of equal diameter with its end wall fixed to the end wall of the standard shell. The standard shell of the extended housing contains a conventional latch bolt and deadlocking mechansim, and this is actuated by tailpiece means which extends to the rear of the extended housing for connection with the retractor of a cylinder lock chassis. The rear of the extended housing carries ears for connection with such chassis, preferably as part of a back plate which also locates and guides the tailpiece means. With a short housing extension, the tailpiece means may be a lengthened standard tailpiece. With a longer extension, the standard front shell assembly includes a standard tailpiece, and a second standard tailpiece member is attached thereto by a rotatably engaged connector. The back plate guides the second tailpiece member in a fixed orientation so as to maintain the connector in engagement.

24 Claims, 10 Drawing Figures

EXTENDED LATCH TUBE ASSEMBLY

This invention relates to cylindrical door locks, also referred to as bored lock and latch sets, and especially to extended latch tube assemblies to give increased backset of the lock chassis from the door edge.

Cylindrical door locks comprise a latch tube assembly mounted in an edge bore of the door and a chassis assembly, including door knob supports, mounted in a through-bore and positioned for interengagement with the housing and the bolt-retracting tailpiece of the latch tube assembly. For heavy-duty cylindrical locks, the backset, or distance from the edge of the door to the axis of the knob and chassis assembly, is conventionally a standard distance of $2\frac{3}{4}$ inches. In certain installations, however, increased backsets are desirable, and it is conventional to provide for backsets of $3\frac{3}{4}$ inches and 5 inches.

Various expedients have been used to provide such increased backsets, and particularly by interposing a separate extension unit or assembly between the rear of a standard latch tube assembly and the chassis. While these have been satisfactory in solid wood doors where the edge bore provided a continuous surrounding wall to support the standard latch tube and its extension assembly in alignment and properly interconnected, serious problems have arisen when such separate latch tube extensions have been used in hollow doors, and particularly in hollow metal doors, in which there is no such continuous surrounding wall and the jointed ends of the standard latch tube assembly and the extension lie in hollow space in the door and have no support to hold them in alignment and in connected relation. In such hollow door applications, the extension assembly can become disengaged from the standard latch tube assembly, and this results in a lock-out condition in which the deadlocking latch bolt of the latch tube assembly is deadlocked in projected position and cannot be retracted by normal operation of the chassis retractor. It has been proposed to apply supporting sleeves to the joints at the time of installation, but these depend on the skill of the installer and are not entirely satisfactory.

It is the primary object of the present invention to provide extended latch tube assemblies which substantially embody standard parts of a standard latch tube assembly, but also include extension mechanism which has a fixed relationship to the standard latch tube mechanism so that the extended latch tube assembly is a self-contained unit requiring no external support and which therefore avoids the occurrence of a lock-out condition such as occurs with prior art mechanism for providing increased backsets.

A cylindrical door lock in accordance with the present invention comprises a chassis and knob assembly, of any desired construction, which includes frame jaws for connection with the housing of the latch tube assembly and includes retractor jaws for engagement with the tailpiece of such latch tube assembly. Preferably, and as here shown, the chassis and knob assembly is as shown in the co-pending application of Walter E. Best and William R. Foshee, Ser. No. 309,564, filed Oct. 8, 1981 now U.S. Pat. No. 4,318,558. The extended latch tube assemblies of the present invention include bolt deadlocking mechanism which may be of any desired and suitable construction. Preferably, and as here shown, such deadlocking mechanism is as shown in U.S. Pat. No. 4,318,558, issued Mar. 9, 1982, to Walter E. Best and William R. Foshee.

In accordance with the invention, an extended latch tube housing is formed by starting with a standard housing comprising a deep-drawn tubular shell having an integral rear wall. An extension housing is attached thereto and preferably comprises a deep-drawn tubular shell having an integral end wall which is fastened to the rear end wall of the standard housing shell, with the two shells in axial alignment. The extension shell is desirably of the same diameter as the first standard shell, and the assembly forms a rigid elongated tubular housing adapted to be inserted into the edge opening of a door in the same way as a standard latch tube housing but to extend farther into the door to provide increased backset. The rear open end of the tubular extension housing is preferably fitted with a back plate adapted to guide the rear end of extended tailpiece means. The rear end of the extension tube, or preferably the back plate fixed therein, is formed with a pair of outward bent ears for engagement by the conventional jaws of the chassis housing.

The standard housing tube at the front end of the extended latch tube assembly is fitted with any desired deadlocking bolt mechanism. This preferably includes a latch bolt, a deadlocking tumbler, and an auxiliary latch bolt for controlling the deadlocking tumbler, and these parts are interconnected in the usual or standard way with the front end of a tailpiece. In the preferred deadlocking mechanism as shown in U.S. Pat. No. 4,318,558, the tailpiece has a rearward portion of uniform cross section which extends through a relatively thick guide block mounted against the rear wall of the standard latch tube, which block forms a guideway which accurately guides the tailpiece for axial movement. For purposes of maintaining the desired normal position of the tailpiece at the rearward limit of the limited lost motion between it and the latch bolt, the tailpiece is provided with a stop which engages against the rear face of the guide block. In the extended latch tube assembly, the tailpiece means includes a forward portion, ahead of the stop, like that of the standard latch tube and extends rearward from such stop and guide block through the length of the extension tube and through the back plate at its rear end. The rear end of the extended tailpiece means carries a head for engagement with the jaws of the chassis retractor.

In an extended latch tube assembly providing a relatively short backset increase, for example, to give a total backset of $3\frac{3}{4}$ inches, the tailpiece extension is desirably provided by using a unitary tailpiece of increased length, sufficient to dispose its head in the desired operating position at the rear of the extended latch tube assembly. In a longer extended latch tube assembly, for example to give a total backset of 5 inches, the tailpiece means may consist of a standard tailpiece with its head in the standard position behind the rear wall of the standard latch tube housing and a separate latchpiece extension which is connected to the head of such standard tailpiece and extends to the rear of the assembly. Such separate extension latchpiece may be a duplicate of the standard tailpiece, and is connected to such standard tailpiece by a connector which is slidably guided in the tubular shell of the extension housing. The extension tailpiece may also be supported at the rear by a back plate mounted at the rear end of the extension tube.

The accompanying drawings illustrate the invention and show embodiments providing $3\frac{3}{4}$ inch and 5 inch backsets and exemplifying the best mode of carrying out the invention as presently perceived. In such drawings.

Figure 1:
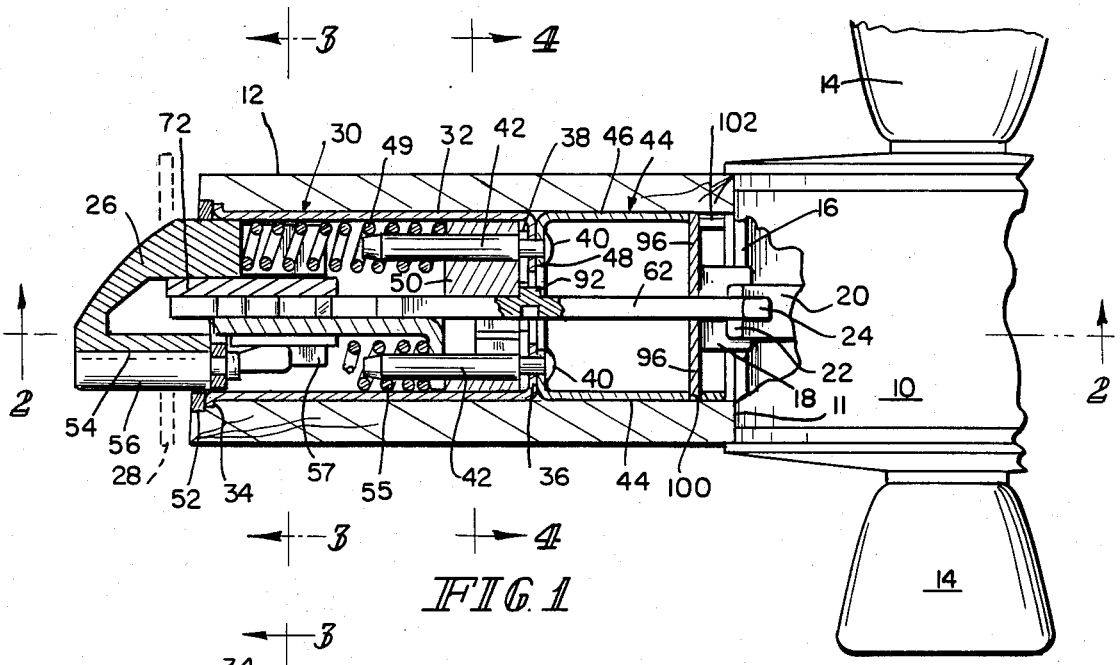
FIG. 1 is a horizontal section of a cylindrical lock including an extended latch tube assembly in accordance with the invention to provide a $3\frac{3}{4}$ inch or analogous relatively short setback.

The cylinder lock shown in FIGS. 1–5 comprises a cylinder lock chassis 10 mounted in a cross bore 11 in a door 12 and provided with two opposite knobs 14. As is conventional, the housing or frame of the chassis 10 is formed with an axial slot defined by edges 16 which engage outspread ears or prongs 18 at the rear of the extended latch tube assembly described below. The chassis contains a bolt retractor 20 operated by the knobs 14 and including forward jaws 22 which engage a head, shown as a cross bar 24, at the rear of the extended tailpiece of the latch tube assembly for retracting the tailpiece and disengaging the bolt 26 of the lock from a strike 28 mounted in the doorjamb in the usual way.

The extended latch tube assembly shown in FIGS. 1–5 comprises a standard latch tube housing 30 in the form of a deep-drawn cylinder 32 with an out-turned rectangular flange 34 at its open outer end and an end wall 36 at its inner end. Such end wall is formed with a central aperture to pass with wide clearance the tailpiece described below. A back plate 38 is seated against the rear wall 36 and is riveted thereto by rivets 40 integral with spring guide pins 42. An extension housing 44 in the form of a deep-drawn tube having a cylindrical side wall 46 and an end wall 48 is connected in axial alignment with the inner end of the latch tube housing 30. The end wall 48 lies flat against the end wall 36 of the tubular housing 30 and is secured thereto by the rivets 40.

The forward standard latch tube 30 contains deadlocking bolt mechanism, preferably like that shown in U.S. Pat. No. 4,318,558. This comprises the latch bolt 26 slidably mounted in the front end of the latch tube 30 and spring-pressed forward by a spring 49 engaged about one of the guide pins 42 and bearing against a thick guide block 50 at the rear of the tube. The latch bolt 26 is stopped in projected position by engagement of stop shoulders thereon against a face plate 52 which is fixed to the front flange 34 by integral rivets formed about mounting screw holes in the face assembly. The bolt is beveled at one side and has a generally flat rear face 54. An auxiliary bolt 56 is mounted against such face and seated in a shallow longitudinal groove therein. The auxiliary bolt 56 is biased forward by a spring 55 engaged about the other guide pin 42 and reacting between the bolt and the out-turned foot 82 of a tumbler 80, bearing on the guide block 50. The latch bolt has a central cavity and a rearward-extending skirt 57 of generally circular cross section but with a number of interruptions, including a side slot to receive the spring 49, an edge slot 58, and a diametrically opposite edge window 60. The bolt is connected to a tailpiece 62 having a forward head which includes a forward tongue 64, a bolt-retracting side arm 66 for engagement in the window 60 of the bolt skirt, and a blocker arm 68 which extends oppositely into blocking relation with the side wall of the latch tube to prevent disengagement of the side arm from the bolt skirt. The forward head of the tailpiece is engaged by a cam member 70 in the form of a shallow channel having a bottom wall 72 which lies flat against the back face of the cross head and has a forward nose extending into guided relation with the cavity in the bolt. The bottom wall 72 is connected at one side to an upstanding side wall 74 formed with an opening which closely embraces the arm 66 and lies between the edge of the tailpiece head and the adjacent side of the skirt 57 of the bolt. The opposite edge of the cam member 70 carries a side wall 76 which is slotted to closely receive the blocker arm 68. The rear edge of the side wall 74 defines a cam face 78 for actuating the deadlocking tumbler as described below. The cam member 70 is held in substantial alignment with the bolt and serves to guide the forward head of the tailpiece for axial movement in the latch tube 30.

Figure 2:
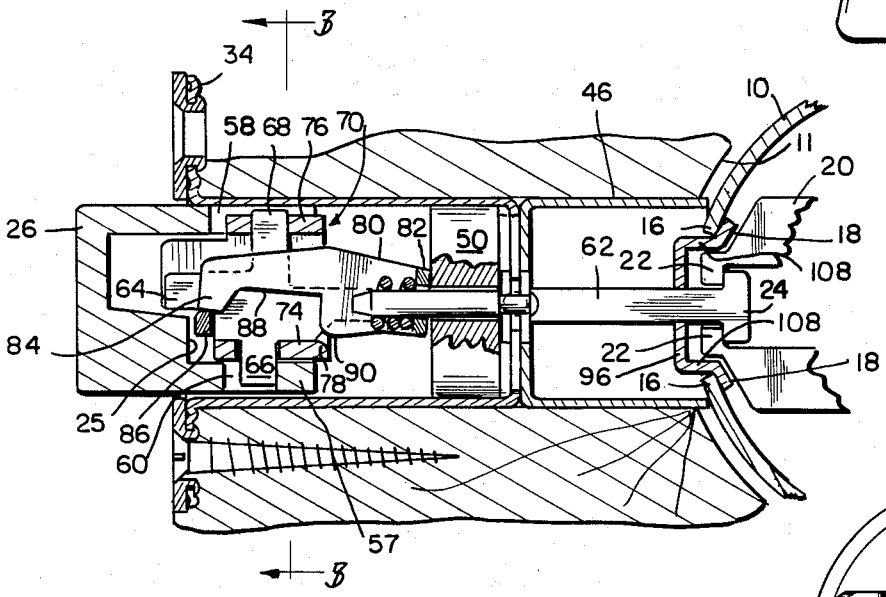
FIG. 2 is a vertical section taken on the line 2—2 of FIG. 1, showing the latch tube in its normal projected position and the deadlocking tumbler in its non-deadlocking position.
Figure 3:
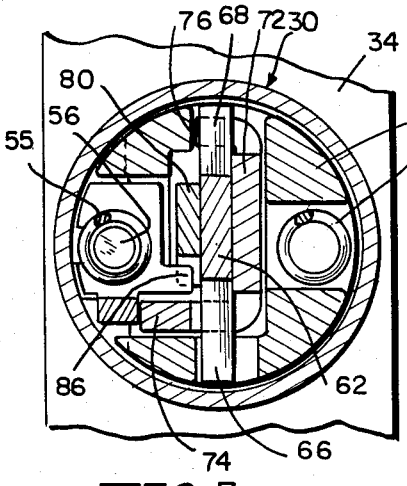
FIG. 3 is a vertical section taken on the lines 3—3 of FIGS. 1 and 2.

A deadlocking tumbler 80 is mounted with its forward leg against the front face of the tailpiece head, by means of an out-turned foot 82 received over a spring guide pin 40 and spring-pressed against the front face of the guide block 50 by the biasing spring 55 for the auxiliary bolt. Such tumbler has a forward blocking nose 84 adapted to lie in blocking relation with a rear face 25 of the bolt 26, but to be held in non-blocking position by a finger 86 controlled by the auxiliary bolt 56. As shown in FIG. 2, the tumbler 80 is thus held in its non-blocking position to permit free retraction movement of the bolt 26 with the auxiliary bolt 56 when the bolt is thrust rearward by engagement with the strike 28. When the door is closed and the latch 26 engaged in the strike, the auxiliary bolt is held in retracted position by the strike and the tumbler-controlling finger 86 is moved rearward into a deep undercut 88 in the tumbler 80 to allow the blocker nose 84 to lie in the path of the rearward face 25 of the bolt 26 and thereby deadlock that bolt against retraction. Rearward of such undercut 88, the tumbler 80 was formed with a cam face 90 which, when the tumbler is in deadlocking position, will be engaged by the cam ramp 78 on the tailpiece cam member 70 as the tailpiece is pulled rearward, so as to move the tumbler out of deadlocking position when the bolt is retracted by the tailpiece. A limited amount of lost motion is provided between the blocker nose 84 and the bolt face 25 to permit the cam ramp 78 to act on the cam nose 90 of the tumbler to move the tumbler nose 84 out of deadlocking position when the bolt is retracted by the tailpiece, and a corresponding limited amount of lost motion is provided between the retraction arm 66 of the tailpiece and the forward edge of the window 60 in the skirt of the bolt in which such retraction arm 66 is engaged, so as to permit the bolt to move rearward against the deadlocking nose 84 of the tumbler 80 when the deadlocked bolt 26 is pushed rearward. In order to maintain the lost-motion clearances and maintain the tailpiece and its connected parts at the rearward limit of its lost motion, the tailpiece carries a stop stud 92 behind the guide block 50 in a position to engage that block as a stop to hold the tailpiece 62 and its head rearward.

Figure 4:
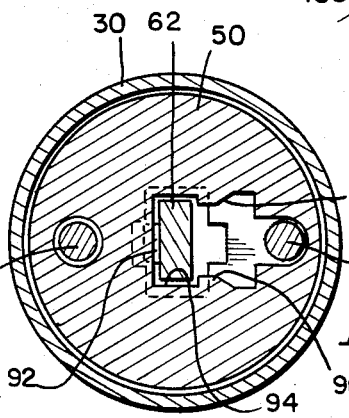
FIG. 4 is a vertical section taken on the line 4—4 of FIG. 1.

As shown in FIG. 4, and more fully explained in U.S. Pat. No. 4,318,558, the guide block 50 is formed with a generally rectangular guideway 94 to guide the rectangular cross section of the tailpiece 62. Such guideway has a lateral entranceway defined between two ribs 96, and such entrance connects with a side opening of suitable size and shape to pass the rear cross head 24 of the tailpiece, with the tailpiece at right angles to the position shown in FIG. 4. A forward portion of the tailpiece, ahead of the guide block 50, is made narrower than the cross section shown in FIG. 4 so that the tailpiece 62 can be inserted rearward through the guide block 50 to the narrow portion, then rotated and passed laterally through the entrance between the ribs 96 and then moved forward in guided relation with the guideway 94 to its operative position shown.

Figure 5:
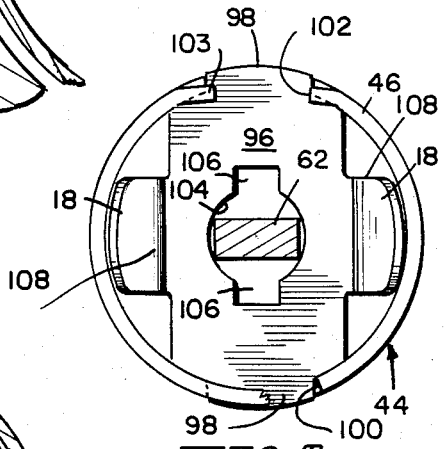
FIG. 5 is a rear elevation of the latch tube assembly shown in FIG. 1, with the tailpiece broken away and shown in section where it passes through the back plate.

The modification shown in FIGS. 1–5 comprises extended tailpiece means comprising a unitary tailpiece 62 which has an integral rearward portion extending from the stop boss 92 to the rear crosshead 24 through the length of the extension tube 46 and therebeyond to position the crosshead 24 for engagement by the jaws 22 of the retractor. The rear end of such tailpiece is loosely guided by a back plate 96 mounted at the rear of the extension tube 44. As shown in FIG. 5, such back plate 96 has a central body portion adapted to fit within the cylindrical wall 46 of the extension housing 44 and has opposite radially projecting tongues 98. The cylindrical wall 46 is formed at one side with a slot 100 to receive one of such tongues 98 and is formed at the opposite side with a notch 102 to receive the opposite tongue 98. The center of the back plate 96 is formed with a generally circular opening 104 having opposite side notches 106 of sufficient size to pass the cross head 24 of the tailpiece 62, with the back plate rotated 90° from the position shown in FIG. 5. Once the cross head has passed through the opening 104, the back plate is rotated 90° to the position shown, in which the straight rectangular cross section of the tailpiece lies diametrically across the circular opening 104 so as to be guided by the circular edges of that opening. The back plate is then assembled to the tube 46 by first entering one of its tongues 98 in the slot 100 of the tube, then moving the other tongue into the notch 102 and bending the edges 103 of the notch inward to secure the back plate in place in the end of the tube.

The ears or prongs 18 of the extended latch tube assembly which are engaged by the jaws 16 of the chassis may be formed on the extension housing 44 but are preferably formed on the back plate 96. For this purpose, the back plate 96 has two opposite side projections 108 which, as shown in FIG. 2, are bent rearward from the back plate and thence outward to form the ears 18.

In assembling the extended latch tube mechanism of FIGS. 1–5, the rear extension tube 44 is brought into abutting relation with the rear wall of the standard latch tube 30, with back plate 38 inserted at the bottom of the latch tube 30 and the three parts riveted together with the rivets 40. The assembly and operation of the deadlocking mechanism is analogous to what is more fully disclosed and described in U.S Pat. No. 4,318,558, and reference is made to that patent. In brief summary, a guide block 50 is assembled on the tailpiece 62 by passing the cross head 24 at the rear of such tailpiece through the opening in the guide block, moving the tailpiece lengthwise to bring its narrowed portion into the guide block, moving such narrowed portion through the entrance between the ribs 96 into the guideway 94, and then moving the tailpiece forward until its stop boss 92 engages the rear face of the guide block to position the guide block in its proper position on the tailpiece. The cam 70 is then mounted on the head of the tailpiece and inserted in the skirt 57 of the bolt 26, the tumbler 80 is mounted against the head of the tailpiece, the springs 49 and 55 are mounted on the guide pins 42 and between the guide block 50 and the main and auxiliary bolts 26 and 56, and this assembly is inserted lengthwise through the open front end of the standard latch tube 30. A face plate 28 is then applied to retain the bolt in the assembly, and is riveted to the flange 34 of the standard latch tube 30.

The assembly as so far described leaves the elongated rearward portion of the tailpiece 62 extending through the latch tube extension 44. A back plate 96 is then installed. This is passed over the cross head 24 of the tailpiece while in an orientation to pass such head through the notches 106 of its central opening, and the back plate is then rotated 90° and one of its projecting tongues 98 is engaged in the slot 100. The other tongue 98 is then swung into the notch 102, and the edges 103 of the notch are swaged inward to lock the back plate in place. The circular portion of the hole 104 is then in guiding relation with the rearward portion of the tailpiece 62 to stabilize it and as it is being engaged by the jaws 22 of the retractor, and to provide a supplemental guiding function in addition to the primary guiding function provided by the guide block 50.

The embodiment shown in FIGS. 6–9 is like that of FIGS. 1–5 in that it includes a forward latch tube 130 containing the same latch 26, auxiliary latch 56, and latch-operating and deadlocking mechanism as in FIGS. 1–5. However, the tailpiece 162 is not elongated, but is of a standard length, the same as that used in a standard $2\frac{3}{4}$ inch backset lock. It thus has a rearcross head 124 which lies only a short distance behind the rear wall 136 of the latch tube 130 and behind the stop boss 92 which engages the rear face of the guide block 50 as a stop. A long extension tube 144 in the form of a deep-drawn cylinder has its end wall 148 fitted against the rear wall 136 of the forward latch tube and riveted thereto by rivets 140 analogous to the rivets 40 in FIGS. 1–5. The extension tube 144 is considerably longer than the extension tube 44 of FIGS. 1–5 and is adapted to provide a backset of 5 inches. It includes a cylindrical wall 146 which contains a slot 200 and a notch 202 at the rear to receive the outward-extending tongues 198 of a back plate 196. As before, the back plate is secured in place by bending inward the edges of the notch 202, and carries opposite ears 18 for engagement with the chassis housing.

In this modification, the tailpiece means includes the standard front tailpiece 162 of the front standard latch tube housing 130, and an extension tailpiece 262 which may be and desirably is a second standard tailpiece identical with the front tailpiece 162. Such second tailpiece 262 is connected to the cross head 124 of the front tailpiece 162 by a connector 270, and extends rearward through and in guided relationship with the back plate 196. The tailpiece 262 has a forward head portion 265 including a forward tongue 264 and two oppositely extending side arms 266 and 268. Immediately behind such forward head portion, the stem of the tailpiece is formed with a narrowed portion 263 and therebeyond has a straight section of larger and uniform cross section extending rearward to a rear cross bar 224.

Figure 8:
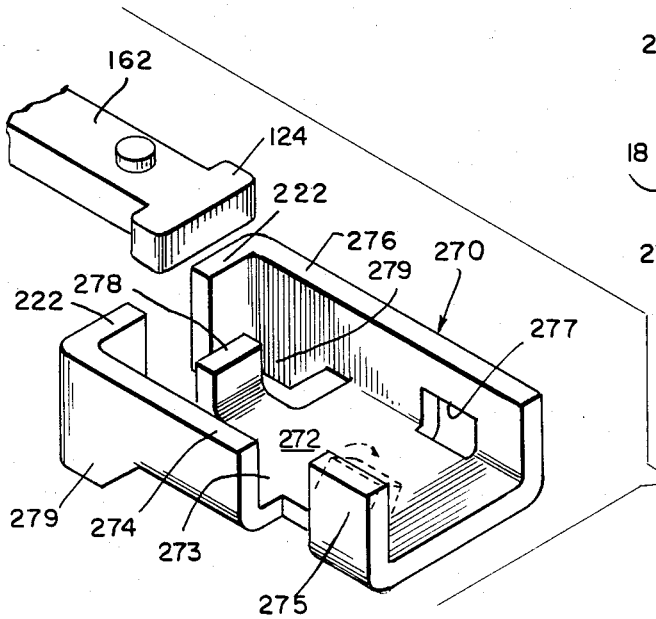
FIG. 8 is a perspective view of the tailpiece connector used in the embodiment of FIGS. 6 and 7, inverted from the position shown in FIG. 6.

As best shown in FIG. 8, the connector 270 between the two tailpieces 162 and 262 is a generally channel-shaped member having a bottom wall 272 and opposite side walls 273 and 276. The rear edge of the side wall 274 defines the front edge of a side notch 273, the rear edge of which is defined by an upstanding tang 275. Such notch receives the side arm 266 of the second tailpiece 262. The opposite side wall 276 of the connector is provided with a window opening 277 to receive the opposite side arm 268 of the tailpiece 262. The side walls 274 and 276 of the connector extend forward beyond the front edge of the bottom wall 272 and are bent inward at their ends to form jaws 222 analogous to the jaws 22 of the retractor, for engagement with the crosshead 124 of the standard first tailpiece 162. The bottom wall 272 of the connector carries a forward tongue which is bent at right angles to form a transverse stop 278 adapted to lie in abutting relation with the end face of the rear cross head 124 of the front tailpiece 162.

Figure 6:
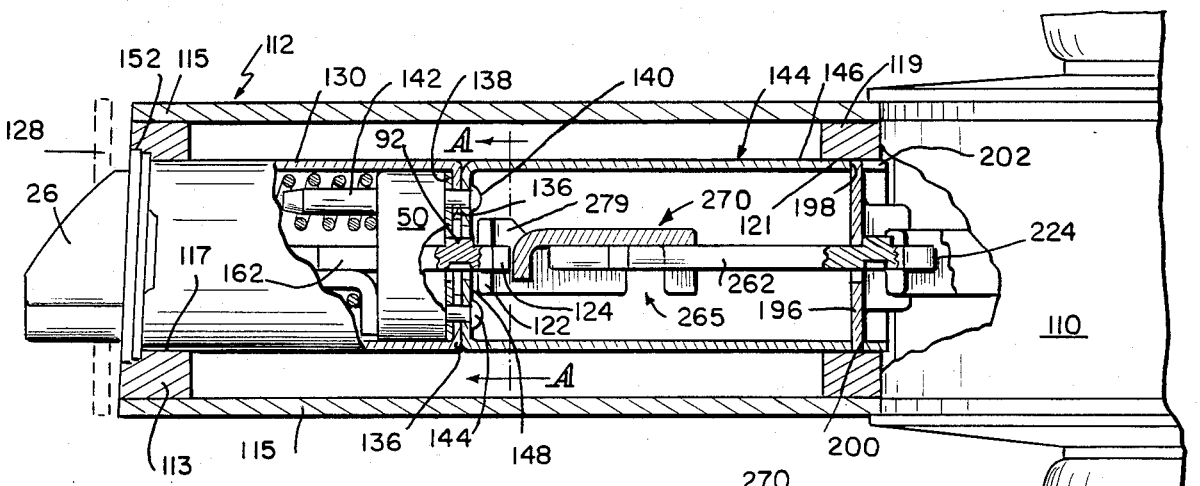
FIG. 6 is a horizontal section of an extended latch tube assembly in accordance with the invention and having a longer extension to provide a 5 inch backset, shown mounted in a hollow door.
Figure 6A:
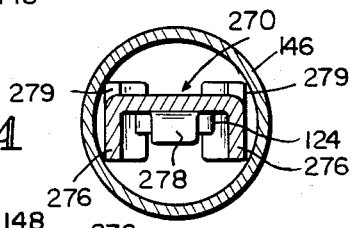
FIG. 6A is a section taken on the line A—A of FIG. 6, showing the guiding relationship of the tailpiece connector in the tubular shell.

The cross head 124 will thus be trapped between the jaws 222 and such stop 278, and the connector will hold the two tailpieces 162 and 262 substantially in end-to-end relationship. As shown in FIG. 6A, the connector has a rectangular profile adapted to be guided and slide freely in the cylindrical wall 146 of the extension tube 144 and thereby to guide the forward end of the extension tailpiece for axial movement in the assembly.

Figure 9:
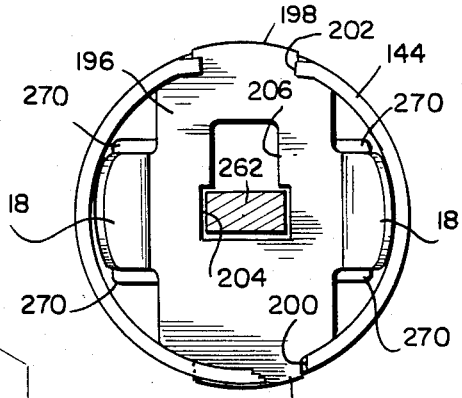
FIG. 9 is a rear elevation of the assembly of FIG. 6, with the tailpiece broken away and shown in section where it passes through the back plate.

As shown in FIG. 9. back plate 196 of the extension tube 144 is formed with a rectangular guideway 204 for guiding the rear straight portion of the tailpiece 262, which guideway communicates at one side with a side opening 206 of sufficient size to permit passage of rear crosshead 224 of the tailpiece through the back plate, and of sufficient width to clear the narrowed portion 263 of the tailpiece. Accordingly, the tailpiece can be inserted edgewise through the combined opening 204–206 to bring its narrow portion 263 into the plane of such opening, can then be rotated in that opening and moved into alignment with the guideway 204, and then be moved longitudinally to engage the rearward straight portion of such tailpiece 262 in the guideway 204 as shown in FIG. 9.

Figure 7:
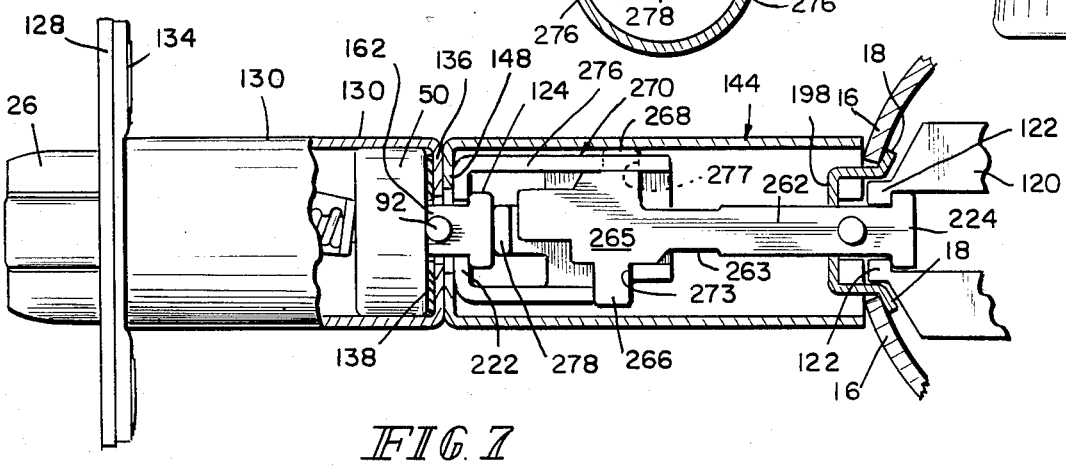
FIG. 7 is a vertical section of the extended latch tube assembly shown in FIG. 6.

Assembly of the embodiment of FIGS. 6–9 is as follows. A latch tube 130 having a front rectangular flange 134 and a rear end wall 136 is assembled with a back plate 138 against the inside face of such back wall and with the end wall 148 of an extension tube 144 against the outside face of such back wall 136, and such parts are riveted together by rivets 140 integral with spring guide members 142. A bolt and deadlocking mechanism and a rear guide block 50 are then assembled to the standard tailpiece 162, this assembly is inserted in the front latch tube 130, and a face plate 128 is applied to the front flange 134, all in a manner indicated above and more fully described in U.S. Pat. No. 4,318,558. A connector 270 is then assembled to a second tailpiece 262 by first inserting the side arm 268 of the tailpiece through the window 277 of the side wall 276 of the connector, and moving the opposite side arm 266 into the notch 273. The upstanding tang 275 is then bent inward over the side edge of the forward head 265 of the tailpiece 262 to lock the connector to the tailpiece. A back plate 196 is then assembled to the rear end of the tailpiece 262 by passing such rear end through the combined opening 204–206 in the back plate 196 in a position at 90° from that shown in FIG. 9. The back plate is moved forward along the tailpiece 262 to the narrowed portion 263, and is then rotated to bring the tailpiece into alignment with the guideway 204, and the back plate is then moved rearward along the tailpiece. This subassembly is then inserted axially through the open rear end of the extension tube 144 with the connector rotated 90° from the position shown in FIGS. 6, 7, and 8 so that the opening between the jaws 222 will lie in the same plane as the cross bar 124 at the rear of the tailpiece 162. This connection can be facilitated by first manually depressing the bolt 26 so as to move the tailpiece 162 and its cross head 124 rearward in the extension tube 144. When the jaws 222 have moved past the cross bar 124, the tailpiece and connector assembly is rotated 90° to a position in which the jaws grasp the cross bar 124 as shown in FIGS. 7 and 8, so as to complete the connection. The back plate is then assembled to the rear end of the extension tube 144 by engaging one of its radial projections 198 in the slot 200 at the rear of such extension tube, then engaging its opposite radial tongue 198 in the opposite notch 202, and then bending the edges of such notch inward as shown in FIG. 9 to lock the back plate in place.

The cylinder lock of FIGS. 1–5 is shown mounted in a door 12 of solid construction in which the extended latch tube is surrounded throughout its extent by the wall of the edge bore. In such a door, installation is the same as with a standard-length latch tube, except that the edge bore is longer and the through bore for the chassis 10 is located at a greater backset distance from the edge of the door. The lock of FIGS. 6–9 is shown mounted in a hollow door 112 having an edge stile 113 fixed between two face panels 115. In this case, the edge bore 117 extends through the stile 113, and supports the latch tube assembly at its outer end. As is known, in such a door, a support ring 119 is desirably inserted between the face panels about the through bore containing the chassis 110 to support such panels against the clamping force with which the chassis assembly is mounted. Such support ring 119 has a lateral bore 121 to receive and support the inner end of the extended latch tube assembly in position for engagement of its fingers 18 with the chassis and for engagement of the head 224 of the tailpiece extension 262 with the jaws 122 of the retractor 120. The extended latch tube, being a rigid assembly of the front tubular housing 130 and the extension housing 144, requires no intermediate support and will be adequately supported and reliably held in proper operating condition by the support it receives at its ends from the stile 113 and the ring 119. Installation requires only insertion of the latch tube assembly into the edge bore 117 and support bore 121 and this will position its inner end parts for interengagement with the chassis as the chassis is mounted endwise into the through bore in the door. In such mounting, the jaws 16 of the chassis will be engaged with the ears 18 of the latch tube assembly to secure the latch tube assembly in place in its edge bore, and the jaws 22 of the retractor will be engaged with the tailpiece crosshead 224 so that retraction movement of the retractor will pull the tailpiece mechanism inward and retract the bolt.

In the embodiment of FIGS. 1–5, bolt retraction movement is transmitted directly from the retractor 20 to the extended one-piece tailpiece 62. In the embodiment of FIGS. 6–9, retraction movement of the retractor is transmitted directly to the extension tailpiece 262 and this acts through the connector 270 to transmit the retraction movement to the tailpiece 124 connected to the bolt 26 of the front latch tube assembly.

With either modification, the operation of the bolt and deadlocking mechanism is as described in U.S. Pat. No. 4,318,558. In the operation of the tailpiece means in both embodiments, the movement of the forward portion of such tailpiece means is accurately guided and controlled by the guide block 50 so as to provide a smooth and accurate operation of the bolt mechanism, and the axial position of the tailpiece is controlled by the stop boss 92 and its engagement with the rear face of the guide block 50, as in the patent. In the embodiment of FIGS. 1–5, the rear end of the extended tailpiece 62 receives supplemental location and support from the guideway in the back plate 96, while in the embodiment of FIGS. 6–9, the second tailpiece 262 is guided at its forward end by the connector 270 which slides axially in the cylindrical extension tube 144, and is guided at the rear by the back plate 198.

The invention provides an extended latch tube assembly of simple construction which can be assembled largely from standard parts of a latch tube of standard length, which provides an extended tubular housing adapted to be mounted in the same familiar way on the standard latch tube, and which is rigidly self-supporting so as to maintain itself in alignment and proper operating conditions in hollow doors.

What is claimed is:

1. An extended latch tube assembly for operative interconnection with a chassis and a retractor of a cylindrical lock mounted at a backset position in a door, comprising a latch tube having an outer and an inner end and having a substantially closed end wall, bolt means including a latch bolt and auxiliary bolt mounted for movement axially of said latch tube at the outer and thereof, first tailpiece guide means at the inner end of said latch tube, a latch tube extension having an outer and an inner end, a substantially closed end wall, and means at its inner end for interconnection with the chassis of the cylindrical lock, the closed end walls of the latch tube and of the latch tube extension being securely fastened together to rigidly and permanently fix the latch tube and the latch tube extension to one another in axial alignment so that the fastened latch tube and latch tube extension cannot be disassembled, and tailpiece means for connecting the bolt means for retraction by the retractor of the cylindrical lock chassis, said tailpiece means including a forward portion connected for retracting the bolt and guided by the bolt and by said guide means in said latch tube for movement axially of the latch tube, said tailpiece means also including a rearward portion extending to the inner end of the latch tube extension and having a connecting means thereon for engagement with the retractor of the cylindrical lock for retraction movement thereby to retract the bolt.

2. An extended latch tube assembly as in claim 1 in which said latch tube and latch tube extension are deep-drawn shells having cylindrical side walls of substantially the same diameter, each end wall being integral with its companion side wall.

3. An extended latch tube assembly as in claim 1 in which the said end walls are disposed in face-to-face relation and mechanically clamped together as by rivets or the like.

4. An extended latch tube assembly as in claims 1 or 2 in which the rearward portion of the tailpiece means is integral with the forward portion.

5. An extended latch tube assembly as in claims 1 or 2 in which the forward portion of the tailpiece means includes a rear connection head and the rearward portion of the tailpiece means is a separate member mechanically connected to said rear connection head.

6. An extended latch tube assembly as in claim 5 in which the rear connection head is a cross bar and said separate member is mechanically connected thereby by spaced jaws adapted to pass the cross bar in one orientation and to engage therewith by rotation to a different orientation.

7. An extended latch tube assembly as in claims 1 or 2 in which the tailpiece forward portion carries a rear connection head, the tailpiece rearward portion comprises a separate element, said two portions being connected by a connector attached to said separate element, the connector having spaced jaws for engaging said connection head, said connector being slidable in said latch tube extension for guiding the separate tailpiece element for axial movement therein, said jaws being adapted to pass the connection head in one orientation of such element and to engage the connection head when rotated to another orientation, and in which the extended latch tube assembly further comprises orienting means in the latch tube extension for maintaining the separate tailpiece element in said second orientation.

8. A latch tube assembly as in claim 1 in which said tailpiece means comprises first and second tailpieces which are alike, each having a front arm adapted to be connected to operate the bolt and a rear cross bar for connection to a retractro of the chassis, and said connector comprises an attachment fixed to the front of the second tailpiece, the attachment having spaced jaws adapted to pass the rear cross bar of the first tailpiece when in one coaxial orientation and to grip such rear cross bar in a second coaxial orientation.

9. An extended latch tube assembly as in claim 7 in which said orienting means comprises a back plate engageable with said latch tube extension after the jaws have been engaged with said connection head and rotated to said second orientation, said back plate including second tailpiece guide means for guiding the separate tailpiece element for bolt retraction movement in said second orientation.

10. An extended latch tube assembly as in claims 1 or 2 in which said forward tailpiece portion has a connector part disposed in said latch tube extension, said rearward tailpiece portion is a separate element to which a companion connector part is attached, said separate tailpiece element is movable in one position to engage said connector parts and movable to an operative position in which it maintains engagement of said connector parts, and in which the extended latch tube assembly further comprises separate tailpiece guide means for guiding said separate tailpiece element for bolt retraction movement axially of said latch tube extension while maintaining the separate tailpiece element in said engagement-maintaining operative position.

11. A latch tube assembly, comprising a front housing comprising a deep-drawn tubular shell having an integral rear transverse wall, a rear housing comprising a deep-drawn tubular shell having an integral front transverse wall, one of said transverse walls being substantially closed, said transverse walls being juxtaposed in confronting relation and mechanically interconnected to permanently fix the two shells in axial alignment so that the interconnected shells cannot be disassembled, the rear housing having means for connecting the assembly to a lock chassis, a latch bolt slidably mounted in the front housing, and tailpiece means for operating said bolt, the tailpiece means having means for connection to a bolt retractor in said lock chassis.

12. A latch tube assembly as in claim 11 in which the means for connecting the assembly to the lock chassis comprises a back plate mounted in the rear housing, the back plate having connector elements for engagement with the lock chassis.

13. A latch tube assembly as in claim 12 in which said back plate forms guide means for guiding the rearward portion of the tailpiece means.

14. A latch tube assembly as in claim 11 in which said tailpiece means comprises a first tailpiece mounted in the front housing for axial movement in a predetermined orientation therein and a second tailpiece axially movable in the rear housing, and in which the latch tube assembly further comprises connector elements carried by the first and second tailpieces and engageable by rotation movement of the second tailpiece, and a guide mounted in the rear housing for guiding the second tailpiece for axial movement while maintaining the second tailpiece rotationally in connected relation with the first tailpiece.

15. A latch tube assembly as in claim 14 in which said connector elements comprise a cross bar on one of said tailpieces and gripper means on the other of said tailpiece, the gripper means being adapted to pass said cross bar in one orientation of the second tailpiece and retain it in a second orientation thereof, and in which the guide in the rear housing is operative to maintain the second tailpiece in said second orientation.

16. A latch tube assembly as in claims 14 or 15 in which said connector elements includes means for slidably engaging the wall of the housing to guide the adjacent end of the second tailpiece for movement axially of the housing.

17. A latch tube assembly, comprising a first housing including a first side wall and a first end wall integral with the first side wall, the first end wall having an outwardly presented face, a second housing including a second side wall and a second end wall integral with the second side wall, the second end wall having an outwardly presented face, a latch bolt mounted for movement in the first housing, tailpiece means for operating the latch bolt, the tailpiece means being mounted for movement in the first and second housings, and means for joining the outwardly presented faces of the first end wall and the second end wall together to rigidly fix the first and second housings in axial alignment such that the two joined housings cannot be disassembled and the tailpiece means is operable therein.

18. The latch tube assembly of claim 17 wherein the first side wall is a first cylindrical shell having a forward and a rearward end and the first end wall substantially closes the rearward end of the first cylindrical shell, and the second side wall is a second cylindrical shell having a forward and a rearward end and the second end wall substantially closes the forward end of the second cylindrical shell.

19. The latch tube assembly of claim 17 wherein the first side wall includes a forward end and a rearward end, the first end wall being integrally coupled to the rearward end of the first side wall, and the second side wall includes a forward end and a rearward end, the second end wall being integrally coupled to the forward end of the second side wall.

20. The latch tube assembly of claim 19 wherein the first housing further includes a mounting flange fixed to the forward end of the first side wall, and the second housing further includes connector means for engaging a lock chassis mounted in a hollow door at a predetermined backset from an edge face of the hollow door whereby the latch tube assembly is self-supportable when installed in the hollow door by attaching the mounting flange to the edge face of the hollow door and by attaching the second housing to the backset lock chassis using the connector means.

21. The latch tube assembly of claim 17 wherein the second housing further includes a second end wall having connector elements for engagement with a lock chassis.

22. The latch tube assembly of claim 19 wherein the second housing further includes a second end wall having connector elements for engagement with a lock chassis, the second end wall being integrally coupled to the rearward end of the second side wall.

23. An extended latch tube assembly, comprising a latch tube including a first substantially closed end wall, a latch extension tube including a second substantially closed end wall, said walls being disposed in face-to-face relation and mechanically clamped together as by rivets or the like, a latch bolt mounted for movement in the latch tube, and tailpiece means for operating the latch bolt, the tailpiece means being mounted for movement in the latch tube and in the latch extension tube.

24. The latch tube assembly of claim 23 wherein the latch tube is a first cylindrical shell having a forward and a rearward end, the first end wall being integrally coupled to the rearward end of the first shell, and the extended latch tube is a second cylindrical shell having a forward and a rearward end, the second end wall being integrally coupled to the forward end of the second shell.

* * * * *